US010295151B2

(12) United States Patent
Mallory et al.

(10) Patent No.: US 10,295,151 B2
(45) Date of Patent: May 21, 2019

(54) OPTICAL MEMBER FOR SPOT FLOOD LIGHTS

(71) Applicant: CoreLED Systems, LLC, Livonia, MI (US)

(72) Inventors: Derek Mallory, Northville, MI (US); Brian Wells, Grosse Pointe Farms, MI (US); Dianna Stadtherr, Novi, MI (US)

(73) Assignee: CoreLED Systems, LLC, Livonia, MI (US)

( * ) Notice: Subject to any disclaimer, the term of this patent is extended or adjusted under 35 U.S.C. 154(b) by 0 days.

(21) Appl. No.: 15/449,201

(22) Filed: Mar. 3, 2017

(65) Prior Publication Data

US 2017/0254504 A1 Sep. 7, 2017

Related U.S. Application Data

(60) Provisional application No. 62/303,790, filed on Mar. 4, 2016.

(51) Int. Cl.

| | |
|---|---|
| ***F21V 1/00*** | (2006.01) |
| ***F21V 5/08*** | (2006.01) |
| ***F21V 5/00*** | (2018.01) |
| *F21Y 115/10* | (2016.01) |
| *F21W 131/103* | (2006.01) |
| *F21Y 105/10* | (2016.01) |

(52) U.S. Cl.
CPC ..... *F21V 5/08* (2013.01); *F21V 5/007* (2013.01); *F21W 2131/103* (2013.01); *F21Y 2105/10* (2016.08); *F21Y 2115/10* (2016.08)

(58) Field of Classification Search
CPC ..... F21V 5/08; F21V 5/007; F21W 2131/103; F21Y 2115/10; F21Y 2105/10
See application file for complete search history.

(56) References Cited

U.S. PATENT DOCUMENTS

2007/0201225 A1* 8/2007 Holder ..... F21K 9/00 362/227
2016/0116138 A1* 4/2016 Hayes ..... F21V 5/046 362/235

* cited by examiner

*Primary Examiner* — Ali Alavi
(74) *Attorney, Agent, or Firm* — Gunther J. Evanina; Butzel Long, PC

(57) ABSTRACT

A one-piece molded lens member for use with a plurality of LEDs in a luminaire includes a generally planar base portion having an upper surface and a lower surface and a plurality of optical structures arranged in rows and columns on the base portion, each optical structure having a hemispheroidal section extending upwardly from the upper surface of the base portion and a first hemicylindrical section extending upwardly from the lower surface of the base portion and from a side of the hemispheroidal section, the optical structure having upper surfaces contiguous with the upper surfaces of the base portion.

19 Claims, 4 Drawing Sheets

OPTICAL MEMBER FOR SPOT FLOOD LIGHTS

CROSS-REFERENCE TO RELATED APPLICATIONS

This application claims priority to U.S. Provisional Application No. 62/303,790, filed Mar. 4, 2016, which is incorporated herein by reference in its entirety.

FIELD OF THE DISCLOSURE

This disclosure relates to optical members and lighting modules for use in lighting fixtures, particularly LED lighting fixtures for outdoor illumination of streets, parking lots, wall landscapes and billboards.

BACKGROUND OF THE DISCLOSURE

Spot and flood lights for outdoor applications have traditionally used sodium vapor lamps or mercury vapor lamps. Halogen lamps and incandescent lamps have also been used, despite higher energy cost, because of lower initial cost. However, LED spot and flood lights are becoming increasingly popular because of their higher overall luminous efficiency, which is typically comparable to or better than sodium vapor lamps and generally much better than mercury vapor lamps and incandescent lamps. LED lamps for spot light and flood light applications generally have a service life that can be 10 to 50 times longer than conventional incandescent lamps and sodium vapor lamps, and typically somewhat longer than mercury vapor lamps. LED spot and flood lamps can generally provide lower overall costs (total energy, initial, replacement and maintenance costs) than the alternatives, especially for high use applications, such as streets, parking lots, walls, landscapes and billboards.

Conventional LED floodlights and spot lights generally comprise a plurality of LEDs arranged in an array or other pattern behind a clear panel or a diffuser. A disadvantage of such designs is that they do not provide a well-defined illumination pattern of relatively uniform intensity and color.

SUMMARY OF THE DISCLOSURE

Disclosed is a one piece molded lens member for use in a luminaire module than can provide a well-defined illumination pattern exhibiting relatively uniform light intensity (irradiance) and color. The lens member includes a base portion and a plurality of optical structures defined on an upper surface of the base portion. Each optical structure extends upwardly from the base portion and includes a hemispheroidal section.

In any of the disclosed aspects, the optical structures can be arranged in an array of rows and columns, e.g., 2×3, 3×3, 3×4, 4×4, etc.

In any of the disclosed aspects, the optical structures can comprise a hemispheroidal section and a hemicylindrical section that extends upwardly from the base portion of the lens member and from a side of the hemispheroidal section.

In any of the disclosed aspects, the optical members can include a generally planar base portion having an upper surface and a lower surface and a plurality of optical structures, each optical structure having a hemispheroidal section extending upwardly from the upper surface of the base portion, and a plurality of recesses extending upwardly into the bottom of the generally planar portion of the base, with each recess being associated with, and extending toward, a corresponding hemispheroidal section.

In any of the disclosed aspects, the optical structures and recesses can be configured so that each optical structure refracts light emitted from a light source positioned under the optical structure and redirects the light away from surfaces of the optical structure toward an area of a targeted surface spaced away from the upper surface of the lens member, with each optical structure focusing light on a different area of the targeted surface to generate a composite illumination pattern on the targeted surface that has well defined boundaries and relatively uniform light intensity.

In any of the aspects disclosed, the lens member can be made of an optically transparent thermoplastic material, such as an acrylic polymer.

Any of the disclosed lens members can be employed in a luminaire module that includes a substrate and a plurality of LEDs mounted on the substrate, with the lens member mounted over the substrate such that each optical structure is positioned adjacent to, and over, a corresponding LED.

DETAILED DESCRIPTION OF THE EMBODIMENTS

Figure 1:
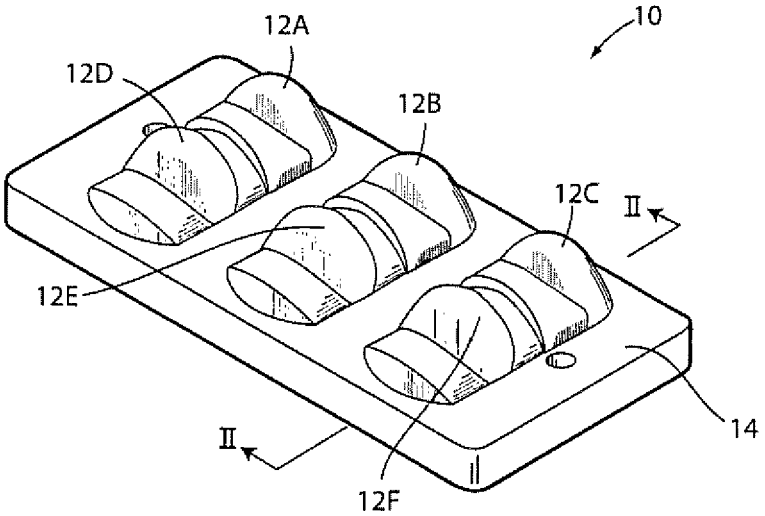
FIG. 1 is a perspective view of a one-piece molded lens member having a plurality of optical structures in accordance with this disclosure.

Shown in FIG. 1 is a one piece molded lens member 10 having a plurality of optical structures 12A-12F defined thereon. Each of the optical structures 12A-12F includes a hemispheroidal section 13 (FIG. 2) that extends upwardly from a base portion 14 that is generally planar. Base portion 14 has an upper surface 16, a lower surface 18, and a peripheral flange portion 20. Each optical structure 12A-12F of the illustrated lens member 10 includes a hemicylindrical section 22 that extends upwardly from base portion 14 and from a side of the associated hemispheroidal section 12A-12F. The term "hemispheroidal" includes shapes that are approximately the shape of a bisected spheroid, with the term "spheroid" encompassing three dimensional shapes that are approximately that of a shape generated by a half-revolution of an ellipse around its major axis, and includes hemispheroidal shapes that are truncated. The term "hemicylindrical" includes shapes that are approximately generated by bisecting a cylinder through a plane parallel with and coinciding with or approximately coinciding with the cylindrical axis.

Figure 2:
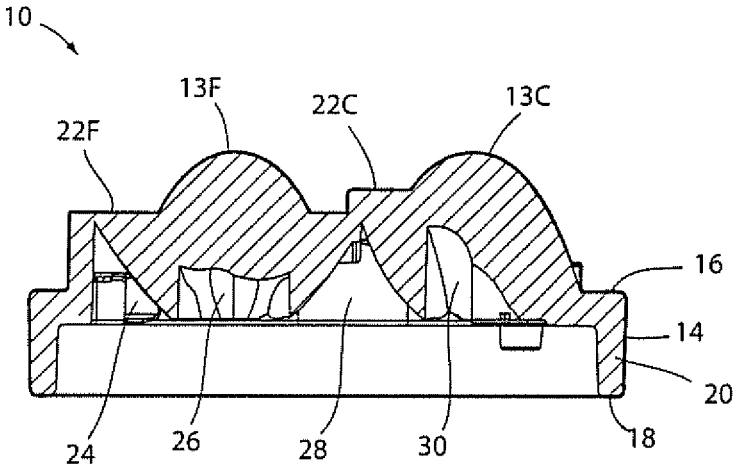
FIG. 2 is a cross-sectional view of the one-piece molded lens member of FIG. 1.
Figure 3A:
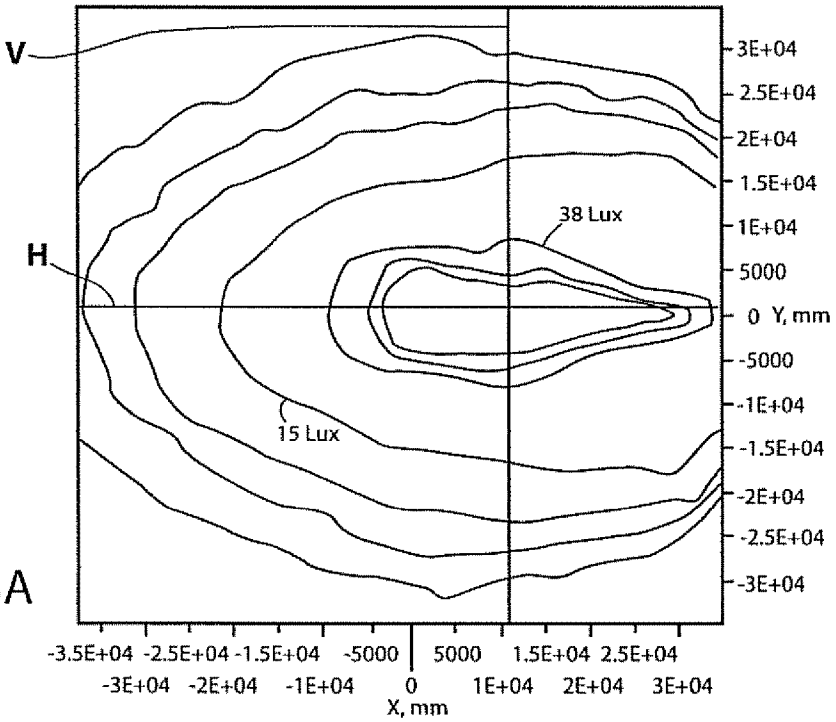
FIGS. 3A-3C are graphs illustrating illuminence as a function of position on an illuminated surface for light radiated from a lens member in accordance with this disclosure that is pointed 70 degrees from vertical.
Figure 3B:
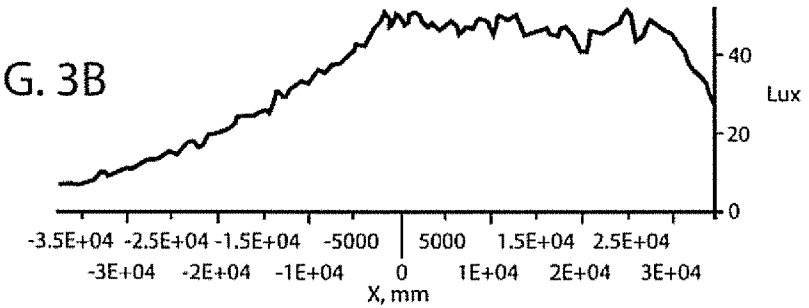
Figure 3C:
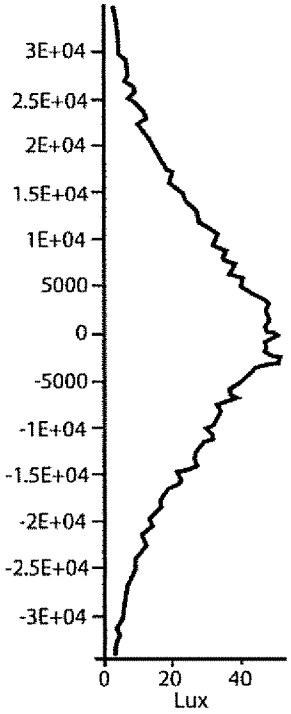

As shown in FIG. 2, lens member 10 includes a plurality of recesses 24, 26, 28 and 30 that extend upwardly from the lower surface 18 of the planar base portion 14. Each recess is associated with a corresponding hemispherical section 13 or hemicylindrical section 22. Recesses 24 and 28 are approximately triangular or have a deltoid shape that provides total internal reflection of low angle light rays emitted from an LED positioned below a hem ispheroidal section 12 of the optical structures 13. Recesses 26 and 30 are configured to reflect and refract light so that light from an LED positioned below recess 30 is directed in a beam pattern that is focused to the right of the beam pattern formed from an LED positioned below recess 24, and so that the beam patterns have sharply defined edges that are juxtaposed or slightly overlapped to provide homogenous irradiance for the combined composite pattern. Additional rows and columns of optical structures 12 and associated recesses 24, 26, 28, 30 can be added so that light from an LED associated with each of the optical structures can be focused at different juxtaposed areas of a targeted surface (i.e., an area that is to be illuminated) to form a composite illumination pattern having well defined boundaries and relatively uniform light intensity. The expression "well defined boundaries" means that irradiance remains within a narrow range (e.g., within 25% of a maximum) over a contiguous area and sharply decreases outside the contiguous area. This is illustrated in FIGS. 3A, 3B and 3C, which show irradiance on a targeted surface as a function of position. FIG. 3A shows lines of consistent irradiance on a surface as a function of position. FIG. 3B shows irradiance as a function of position along the horizontal axis (labeled "H" in FIG. 3A) and FIG. 3C shows irradiance as a function of position along the vertical axis (labeled "V" in FIG. 3A). The data shown in FIGS. 3A-3C were generated using a six LED luminaire module comprising the lens member 10 shown in FIGS. 1 and 2. The maximum irradiation was about 53 lux (lumens per square meter) with a relatively sharply defined area at or above 38 lux, which has an approximate length of 35 meters and an approximate height of about 10 meters. As can be seen by reference to FIGS. 3B and 3C, the irradiance is relatively flat over this region varying between about 40 and 50 lux, then sharply and substantially continuously decreasing outside the region. As a consequence, it is possible to position and aim a plurality of LED luminaire modules as disclosed so that the illuminated areas of each module are arranged approximately edge-to-edge to provide continuous, uniform irradiance over a very large contiguous area, such as a street, parking lot, building wall, billboard, etc.

As can be seen by reference to FIGS. 3A through 3C, and particularly FIG. 3*a*, the lens member of this disclosure diffracts light to provide an asymmetric flood pattern that can be described as having a narrow ovate shape, i.e., an egg shaped or cigar shaped illuminance pattern, which is generally oval and symmetrical with respect to an axis in the length direction, but asymmetrical with respect to a perpendicular axis in the width direction. The shape is narrow in the sense that the length direction of the ovate shape traced by the lines of constant illuminance are at least twice the width. Stated differently, the lines of constant illuminance as a function of position trace a shape approximated by a long portion that approximates half of an oblate sphere in three-dimensions or, as shown if FIG. 3A, a long portion that approximates half of a prolate ellipse and a short portion that approximates half of a circle in two dimensions. This can be most easily seen by reference to the lines of constant illuminance at and above 38 Lux in FIG. 3A.

The flood or illuminance pattern created by the disclosed lens members can be used to build highly uniform composite patterns using multiple lens members in a single luminaire that provide an Illuminating Engineering Society (IES) type 2, 3 or 4 LED distribution pattern depending on how the lenses in the fixture are aimed.

Figure 4A:
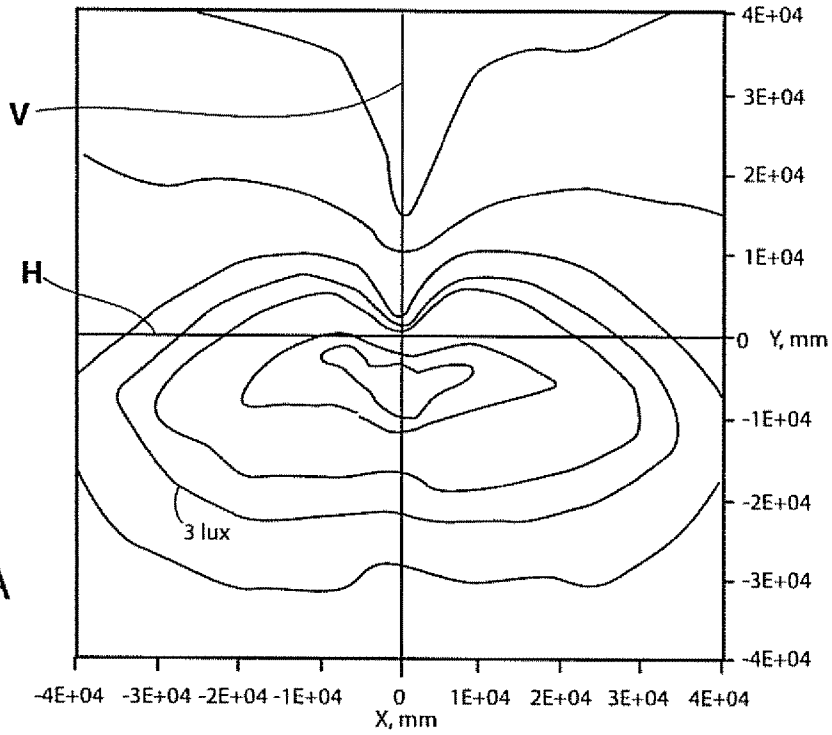
FIGS. 4A-4C are graphs illustrating illuminence as a function of position for a lens member in accordance with this disclosure having 16 optical structures.
Figure 4B:
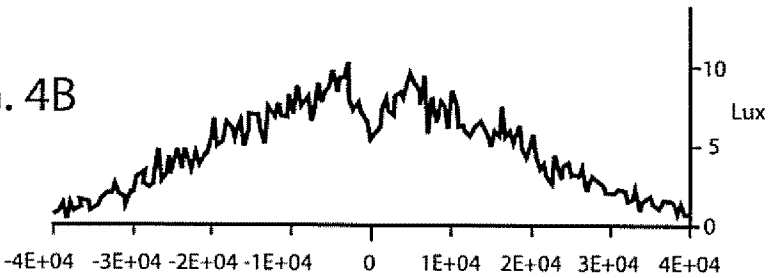
Figure 4C:
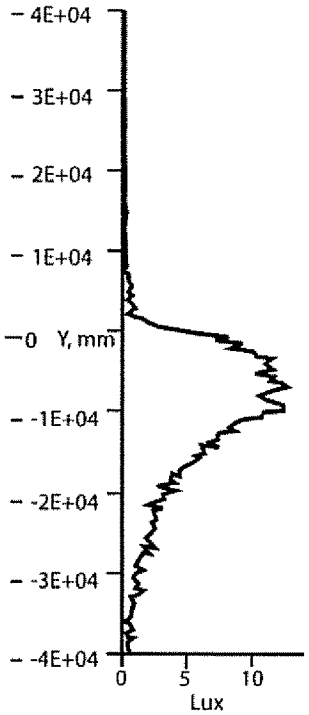

FIGS. 4A-4C show another example using a lens member having 16 optical structures arranged in a four row by four column array. In this example, lower illumination intensity was targeted for building sidewall illumination. In this case, there is a fairly well defined region of irradiance between about 5 and 10 lux that is about 40 meters by about 20 meters.

Figure 5:
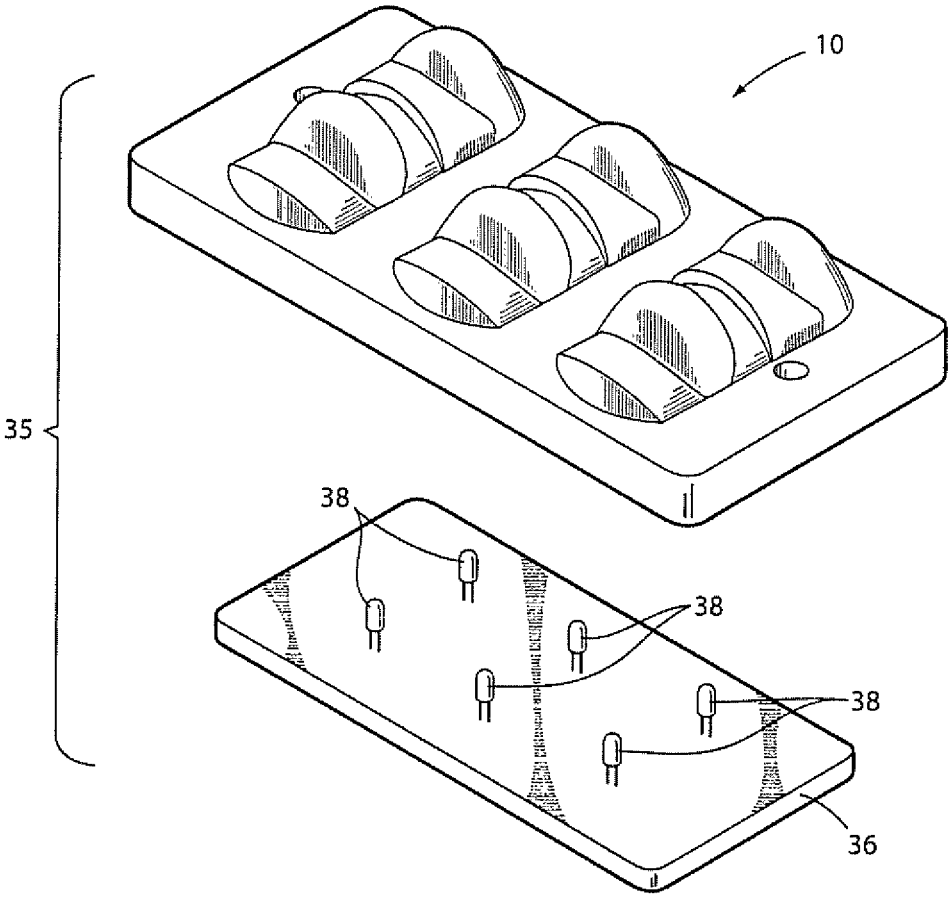
FIG. 5 is an exploded perspective of a luminaire module in accordance with this disclosure.

FIG. 5 shows a luminaire module 35 including a substrate 36, a plurality of LEDs 38 mounted on the substrate and the one piece lens member 10 disposed over the LEDs and substrate. Electrical conductors are provided, such as on the substrate, to electrically connect the LEDs to a power source. The substrate 36 can be a printed circuit board.

The lens member 10 can be made of an optically transparent material, such as glass, thermoplastic, or thermoset resin. A transparent acrylic or polycarbonate material can be used. The apexes at the optical structure 12 can be arranged in rows spaced apart by about 10 mm to 15 mm and in columns spaced apart about 15 mm to about 25 mm.

While the present invention is described herein with reference to illustrated embodiments, it should be understood that the invention is not limited hereto. Those having ordinary skill in the art and access to the teachings herein will recognize additional modifications and embodiments within the scope thereof. Therefore, the present invention is limited only by the claims attached herein.

What is claimed is:

1. A one piece molded lens member comprising:

a generally planar base portion having an upper surface and a lower surface and a plurality of optical structures arranged in rows and columns on the base portion, each optical structure having a hemispheroidal section extending upwardly from the upper surface of the base portion and a first hemicylindrical section extending upwardly from the lower surface of the base portion and from a side of the hemispheroidal section, the optical structure having upper surfaces contiguous with the upper surfaces of the base portion.

2. The one piece molded lens member of claim 1, made of an optically transparent thermoplastic material.

3. The one piece molded lens member of claim 2, wherein the optically transparent thermoplastic material is comprised of an acrylic polymer.

4. The one piece molded lens member of claim 1, wherein the optical structures are arranged in a two rows by three columns array.

5. The one piece molded lens member of claim 1, in which a plurality of recesses extend upwardly from the lower surface of the generally planar base portion, each recess associated with and extending toward a corresponding hemispheroidal or hemicylindrical section.

6. The one piece molded lens member of claim 5, in which each recess extending upwardly toward a hemicylindrical portion has a generally triangular profile.

7. The one piece molded lens member of claim 1, in which a reduced diameter hemicylindrical section extends coaxially between the first hemicylindrical section and the hemispheroidal section of an adjacent optical structure in the same column.

8. The one piece molded lens member of claim 1, in which the rows are spaced apart about 10 mm to about 15 mm, and the columns are spaced apart about 15 mm to about 25 mm.

9. The one piece molded lens member of claim 5, in which each optical structure and each recess is configured to refract light emitted from a source positioned immediately adjacent a corresponding optical structure at the bottom of the generally planar base portion and direct a beam of light toward an area on a targeted surface positioned in relation to the upper surfaces of the optical structure, each beam aimed at a different adjacent area of the targeted surface to generate a composite illumination pattern on the targeted surface.

10. The one piece molded lens member of claim 1, which provides an asymmetric flood pattern having a narrow ovate shape.

11. A luminaire module comprising:

a substrate;

a plurality of LEDs mounted on the substrate;

a one piece molded lens member disposed over the plurality of LEDs, the one piece molded lens member having a generally planar base portion defining an upper surface and a lower surface and a plurality of optical structures arranged in rows and columns on the base portion, each optical structure having a hemispheroidal section extending upwardly from the base portion and a first hemicylindrical section extending upwardly from the lower surface of the base portion and from a side of the hem ispheroidal section, the optical structure having upper surfaces contiguous with the upper surfaces of the base portion, wherein each optical structure is positioned over a corresponding LED to focus light into a desired beam.

12. The luminaire module of claim 11, in which a plurality of recesses extend upwardly from the lower surface of the generally planar base portion, each recess associated with and extending toward a corresponding hemispheroidal or hemicylindrical section.

13. The luminaire module of claim 12, in which each optical structure and each recess is configured to refract light emitted from a source positioned immediately adjacent a corresponding optical structure at the bottom of the generally planar base portion and direct a beam of light toward an area on a targeted surface positioned in relation to the upper surfaces of the optical structure, each beam aimed at a different adjacent area of the targeted surface to generate a composite illumination pattern on the targeted surface.

14. The luminaire module of claim 11, in which each recess extending upwardly toward a hemicylindrical portion has a generally triangular profile.

15. The luminaire module of claim 11, in which a reduced diameter hemicylindrical section extends coaxially between the first hemicylindrical section and the hemispheroidal section of an adjacent optical structure in the same column.

16. The luminaire module of claim 11, in which the rows are spaced apart about 10 min to about 15 mm, and the columns are spaced apart about 15 mm to about 25 mm.

17. The luminaire module of claim 11, in which the one piece molded lens member provides an asymmetric flood pattern having a narrow ovate shape.

18. The luminaire comprising a plurality of luminaire modules in accordance with claim 11.

19. The luminaire of claim 18 in which the luminaire modules are aimable to build uniform composite patterns that can provide different types of LED illuminance patterns.

* * * * *